United States Patent [19]

Inomata et al.

[11] 4,211,585

[45] Jul. 8, 1980

[54] SAMARIUM-COBALT-COPPER-IRON-TITANIUM PERMANENT MAGNETS

[75] Inventors: Koichiro Inomata; Masakazu Yamada, both of Yokohamashi, Japan

[73] Assignee: Tokyo Shibaura Electric Co., Ltd., Tokyo, Japan

[21] Appl. No.: 775,471

[22] Filed: Mar. 8, 1977

[30] Foreign Application Priority Data

Mar. 10, 1976 [JP] Japan ..... 51-24992

[51] Int. Cl.[2] ..... H01F 1/04

[52] U.S. Cl. ..... 148/31.57; 75/170; 148/103

[58] Field of Search ..... 148/31.57, 103, 105, 148/101; 75/152, 170

[56] References Cited

U.S. PATENT DOCUMENTS

| | | | |
|---|---|---|---|
| 3,617,260 | 11/1971 | Detert | 75/170 |
| 3,801,312 | 4/1974 | Steinitz | 75/170 |
| 3,947,295 | 3/1976 | Tawara et al. | 148/31.57 |
| 3,977,917 | 8/1976 | Fujimura et al. | 148/31.57 |
| 3,982,971 | 9/1976 | Yamaka et al. | 148/101 |
| 4,135,953 | 1/1979 | Nagel et al. | 148/103 |

FOREIGN PATENT DOCUMENTS

| | | |
|---|---|---|
| 2727243 | 12/1977 | Fed. Rep. of Germany . |
| 47-38721 | 9/1972 | Japan . |

OTHER PUBLICATIONS

Inomata, K. et al. "Sm-Co-Cu-Fe-Ti Magnets", Japanese Journal of Applied Physics, vol. 17, No. 11, 11/78, pp. 1993-1996.

*Primary Examiner*—L. Dewayne Rutledge
*Assistant Examiner*—Michael L. Lewis
*Attorney, Agent, or Firm*—Oblon, Fisher, Spivak, McClelland & Maier

[57] ABSTRACT

A permanent magnet comprising a composition containing a Sm-Co compound and consisting essentially of 23 to 30 wt. % Sm, 0.2 to 1.5 wt. % Ti, 9 to 13 wt. % Cu, 3 to 12 wt. % Fe and the balance Co which has very high energy products more than about 20 MGOe and excellent rectangular hysteresis loop characteristics which are attained without the necessity of an aging treatment.

2 Claims, 2 Drawing Figures

SAMARIUM-COBALT-COPPER-IRON-TITANIUM PERMANENT MAGNETS

BACKGROUND OF THE INVENTION

1. Field of the Invention

The present invention relates generally to cobalt-rare earth permanent magnets. More particularly, the present invention is concerned with Sm(Co-Ti-Cu-Fe) compositions which have the improved magnetic properties of enhanced coercivity and rectangularity.

2. Description of the Prior Art

E. A. Nesbitt et al, in U.S. Pat. No. 3,560,200, which issued Feb. 2, 1971, discloses the influence of the samarium content on the magnetic behavior of Sm(Co-Cu-Fe) compositions. However, the coercive force level of 4500 Oe which is obtained by Nesbitt's permanent magnet renders the permanent magnetic insufficient for use as a permanent magnet. These conventional rare earth permanent magnets have many deficiencies in that it is necessary to age the magnets after sintering. The manufacturing process is complicated and long manufacturing times are required. Also, the magnetic powder cannot be simply stored because it rapidly oxidizes. A need, therefore, continues to exist for a method by which rare earth alloys can be prepared simply and in a manner such that they are stable to oxidation.

SUMMARY OF THE INVENTION

Accordingly, one object of the present invention is to provide a permanent magnet comprising Sm, Cu, Fe, Ti, and Co, which is characterized by a high coercive force, a high residual flux density, a high maximum energy product, good oxidation resistance and an excellent performance characteristics which are attained without the necessity of an aging treatment.

Briefly, this and other objects of the present invention as hereinafter will become more readily apparent can be attained by a permanent magnet composition containing a Sm-Co compound and consisting essentially of 23 to 30 wt.% Sm, 0.2 to 1.5 wt.% Ti, 9 to 13 wt.% Cu, 3 to 12 wt.% Fe, and the balance Co.

BRIEF DESCRIPTION OF THE DRAWINGS

Various other objects, features, and attendant advantages of the present invention will be more fully appreciated as the same becomes better understood from the following detailed description when considered in connection with the accompanying drawings, wherein.

DESCRIPTION OF THE PREFERRED EMBODIMENTS

The permanent magnets of the present invention are formulated of a composition comprising 23–30 wt.% of Sm (samarium), 0.2–1.5 wt.% of Ti (titanium), 9–13 wt.% of Cu (copper), 3–12 wt.% of Fe (iron) and the balance Co (cobalt).

The magnets of this invention may be produced by any conventional metallurgical process, such as by finely pulverizing a powder mixture, pressing the powder mixture into the shape of a magnet in a magnetic field and then sintering the shaped magnet.

The magnets of the present invention have a residual flux density (Br) of about 10 (KG), a coercive force ($_iH_C$) of about 8 (KOe) and a maximum energy product (BHmax) of about 25 (MGOe), as shown in Table 1.

The influence of the various metal components on the characterstics of the present magnet is as follows:

If the amount of Sm is less than 23 wt.%, the coercive force of the magnet cannot be increased. If the amount of Sm is greater than 30 wt.%, the residual flux density of the magnet will decrease below 9000 Gauss besides the fact that it is expensive to use large quantities of Sm.

Figure 1:
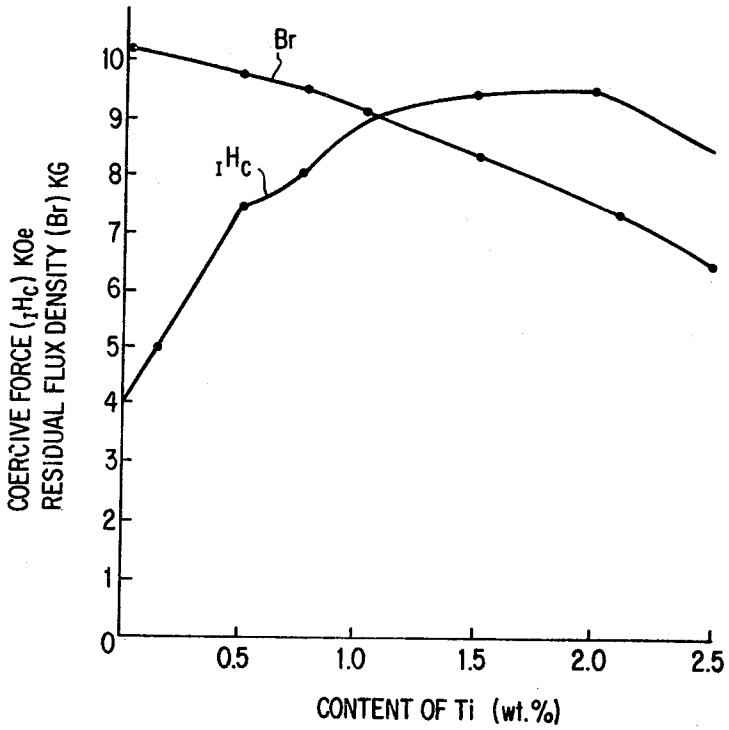
FIG. 1 shows the relationship between the coercive force ($_iH_C$) in kilo-oersteds (KOe) and the residual flux density (Br) in Kilo-Gauss (KG) versus the variation in Ti content as weight percent (wt.%) of the magnet composition.

If the Ti content is less than 0.2, the coercive force ($_iH_C$) of the magnet becomes unsatisfactorily low, and even if the magnet is subjected to an aging treatment, the coercive force cannot be increased to more than 5000 Oe. Also, if the Ti content is greater than 1.5 wt.%, the residual flux density (Br) decreases as shown in FIG. 1 where the contents of the elements other than Ti comprise, for example, 26.0 wt.% of Sm, 7.0 wt.% of Fe, 11.0 wt.% of Cu and the balance Co.

If the Cu content is less than 9 wt.% and greater than 13 wt.%, the value of the coercive force and the value of residual flux density of the magnet are insufficient for a permanent magnet.

Figure 2:
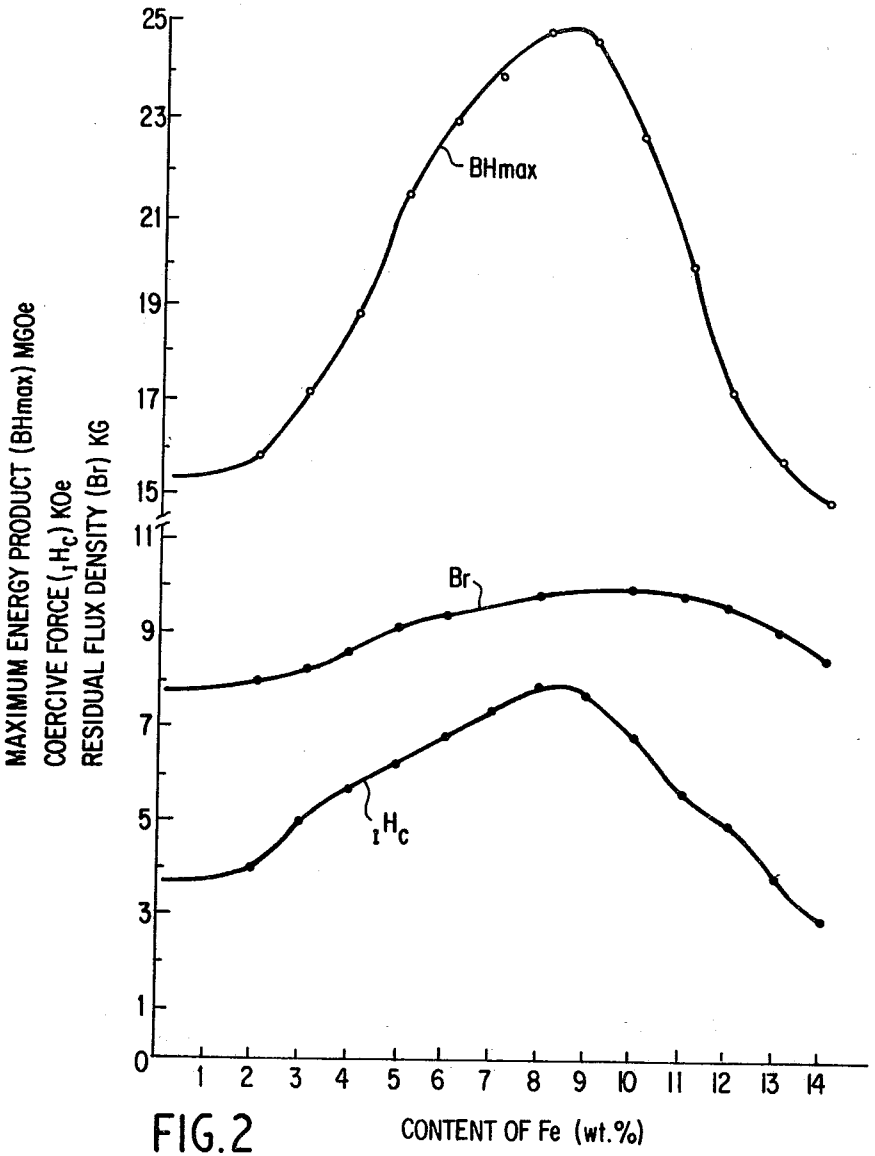
FIG. 2 shows the relationship between the coercive force ($_iH_C$) in Kilo-oersteds (KOe) and the residual flux density (Br) in Kilo-Gauss (KG) and the maximum energy product (BHmax) in Mega Gauss Oersted (MGOe) versus variation in the Fe content in weight percent (wt.%) of the magnet composition.

If the Fe content is less than 3 wt.%, the residual flux density (Br) of the magnet decreases. If the Fe content is greater than 12 wt.%, the coercive force ($_iH_C$) of the magnet decreases. From the viewpoint of the maximum energy of the product (BHmax) the range of Fe is preferably 3 to 12 wt.% as indicated in FIG. 2, wherein the contents of the elements other than Fe comprise, for example, 26.0 wt.% Sm, 0.5 wt.% Ti, 11 wt.% Cu and the balance Co. The permanent magnet of the present invention can be used in the manufacture of loud speakers, magnet ron tubes, motors, and the like.

Having generally described this invention, a further understanding can be obtained by reference to certain specific examples which are provided herein for purpose of illustration only and are not intended to be limiting unless otherwise specified.

EXAMPLES

Various metal mixtures of Ti, Fe, Co, Cu, and Sm were weighted out in order to formulate various compositions for the formation of permanent magnets. The metal mixtures were finely pulverized to a grain size on the order to 4 μm after they were molten in a high frequency furnace. The finely pulverized powder mixtures were pressed and shaped under a pressure of 1 ton/cm$^2$ and in a magnetic field of 20,000 Oersted. The shaped products were then sintered at a temperature of 1200° C. under an argon gas atmosphere for 1 hour. Then the magnets were rapidly cooled to room temperature.

It is possible to substitute Mn (manganese) for Fe in amounts equivalent to the amounts of Fe without impairing the resultant magnetic properties of the magnet such as exemplified by example No. 6 in Table 1.

It should be explained that the quantity of Fe can be increased in the composition in those compositions which do not contain Ti without impairing the high performance of the present magnets.

TABLE 1

| | Composition (wt.%) | | | | | | | | BHmax |
|---|---|---|---|---|---|---|---|---|---|
| | Sm | Ti | Cu | Fe | Mn | Co | Br(G) | $_iH_C$(Oe) | (MGOe) |
| Example 1 | 24 | 1.0 | 12 | 5 | — | bal. | 9000 | 6700 | 19.8 |
| 2 | 26 | 0.5 | 11 | 7 | — | bal. | 9800 | 7500 | 23.9 |
| 3 | 26 | 0.5 | 11 | 8 | — | bal. | 10000 | 8000 | 25.0 |
| 4 | 28 | 1.0 | 10.5 | 7 | — | bal. | 9200 | 8700 | 21.1 |
| 5 | 25.5 | 0.75 | 11 | 6.5 | — | bal. | 9600 | 8500 | 23.0 |
| 6 | 26 | 0.75 | 11 | 4 | 2 | bal. | 9700 | 8700 | 23.5 |
| 7 | 26.5 | 0.75 | 11 | 8.3 | — | bal. | 9800 | 8100 | 24.0 |
| Control 1 | 22 | 2 | 14 | 3 | — | bal. | 7500 | 4300 | 10.1 |
| 2 | 32 | 0 | 8 | 6 | — | bal. | 8200 | 3400 | 9.2 |
| 3 | 27 | 0.5 | 11 | 14 | — | bal. | 9050 | 2800 | 13.4 |
| 4 | 28 | 1.5 | 10 | 2 | — | bal. | 8100 | 8800 | 16.2 |

It is believed that the reason why the coercive force is increased in the present magnets is that the appearance of the $Sm_2Co_{17}$ phase in the magnet composition which is believed to cause a decrease in the coercive force of Sm-Co containing magnets, is suppressed by the inclusion of Ti in the composition. Other reason why the coercive force increases is due to fineness of microstructure composed of $SmCo_5$ and $Sm_2Co_{17}$ phases by including Ti. In the conventional magnets which do not contain Ti, the performance characteristics of the magnets such as coercive force, have been increased through an aging treatment after shaping and sintering of the magnets. When Ti is included in the composition of the present invention, excellent performance characteristics are attained without the necessity of an aging treatment.

The permanent magnets of the present invention exhibit several excellent performance characteristics and effects. For example, the magnetic properties of magnets are not influenced by long periods of storage of the powder because the powder has a substantial oxidation resistance. The maximum energy product (BHmax) of the conventional magnets prepared by the conventional manufacturing process, decreases about 60% when the magnets are manufactured from powder compositions which give rise to the presence of $SmCo_5$ when they are stored for two months in ethyl-alcohol in comparison to the situation in which the magnets are prepared from the powder immediately after pulverization. On the other hand, a magnet prepared from a mixture of the present invention, for example, consisting of 26.5 wt.% Sm, 8.3 wt.% Fe, 11.0 wt.% Cu, 0.75 wt.% Ti and the balance Co, shows only about a 0.05% decrease in the BHmax value when the magnet is prepared under the same conditions. Because of the stability advantage of the permanent magnets of the present invention, the manufacturing process is simplified and the treatment and the storage of the powder starting materials of the magnets is also simplified.

Having now fully described this invention, it will be apparent to one of ordinary skill in the art that many changes and modifications can be made thereto without departing from the spirit or scope of the invention as set forth herein.

What is claimed as new and intended to be secured by Letters Patent is:

1. A permanent magnet, which comprises a composition containing a Sm-Co compound and consisting essentially of 23 to 30 wt.% of Sm, 0.2 to 1.5 wt.% Ti, 9 to 13 wt.% Cu, 3 to 12 wt.% Fe and the balance Co, said magnet having a residual flux density (Br) of about 10 (KG), a coercive force ($I^HC$) of about 8 (KOe) and a maximum energy product (BH max) of about 25 (MGOe), having the aforesaid magnetic properties without the necessity of an ageing treatment.

2. The permanent magnet of claim 1, which consists essentially of 25.5 to 28 wt.% Sm, 0.5 to 0.8 wt.% Ti, 9.5 to 11.5 wt.% Cu, and 6.0 to 10.0 wt.% Fe, the balance being cobalt.

* * * * *